US008161988B2

(12) United States Patent
Ko

(10) Patent No.: US 8,161,988 B2
(45) Date of Patent: Apr. 24, 2012

(54) CENTRAL SHAFT CONTROL STRUCTURE OF SELF-OPENING/CLOSING UMBRELLA

(76) Inventor: Chin-Sung Ko, Hemei Township, Changhua County (TW)

( * ) Notice: Subject to any disclaimer, the term of this patent is extended or adjusted under 35 U.S.C. 154(b) by 122 days.

(21) Appl. No.: 12/700,745

(22) Filed: Feb. 5, 2010

(65) Prior Publication Data

US 2011/0192435 A1 Aug. 11, 2011

(51) Int. Cl.
*A45B 25/16* (2006.01)

(52) U.S. Cl. ..... 135/24

(58) Field of Classification Search ..... 135/15.1, 135/22, 24, 25.4, 25.41
See application file for complete search history.

(56) References Cited

U.S. PATENT DOCUMENTS 4,149,553 A * 4/1979 Lee ..... 135/24
5,174,319 A * 12/1992 Chou et al. ..... 135/20.3
7,798,160 B2 * 9/2010 Chen ..... 135/24
7,971,595 B1 * 7/2011 Ko ..... 135/24
2009/0133729 A1 * 5/2009 Chong ..... 135/20.3
2010/0319739 A1 * 12/2010 Chong ..... 135/24
2011/0114142 A1 * 5/2011 Cai ..... 135/22

* cited by examiner

*Primary Examiner* — Noah Chandler Hawk
(74) *Attorney, Agent, or Firm* — Leong C. Lei

(57) ABSTRACT

A central shaft control structure is provided for a self-opening/closing umbrella and is arranged in a handle of the umbrella for self-opening/closing of the umbrella, including a safety device composed of a reversal prevention wheel having a toothed surface, an operation bar comprising a pawl, and a barrel fit over the operation bar. The reversal prevention wheel comprises a safety rope wrapped therearound and having an end fixed to a third central shaft segment. When errors occur in the course of compression in closing the umbrella, the central shaft that is being compressed can be held in position, so that instantaneous spring back of the central shaft caused by an umbrella opening spring that is in a compressed condition can be prevented to ensure safety of operation and control of the self-opening/closing umbrella.

4 Claims, 10 Drawing Sheets

CENTRAL SHAFT CONTROL STRUCTURE OF SELF-OPENING/CLOSING UMBRELLA

(a) TECHNICAL FIELD OF THE INVENTION

The present invention generally relates to a self-opening/closing umbrella, and more particularly to a centrals shaft control structure of a self-opening/closing umbrella.

(b) DESCRIPTION OF THE PRIOR ART

A conventional self-opening/closing umbrella is shown in FIGS. 1-3. The known umbrella comprises a handle 1 inside which an operation unit 2 is provided, a central shaft unit 3 inside which an umbrella opening spring 6 is received, and a runner 4 coupled to ribs 7 and comprising a pull rope 51 wrapping therearound and having an end fixed to a crown 41 and an opposite end fixed to a bullet-head member 5. The operation unit 2 comprises a hollow body inside which components including a control ring 201, a control bar 202, and a pushbutton 203 are received. The control bar 202 is pivoted to one side of the bottom of the control ring 201. The pushbutton 203 is received in an opening formed in a side wall of the handle 1 and is exposed for controlling the expansion and collapse of the central shaft unit 3. As shown in FIG. 1, the control ring 201 comprises a small spring 2011 externally set at one side thereof to provide a spring force for biasing the control ring 201 toward the pushbutton 203. The control ring 201 forms therein a projection bar 2012 at a location corresponding to the small spring 2011 to engage and retain the runner 4 for keeping the umbrella in a collapsed condition. Further, the control bar 202 is coupled to the bottom of the control ring 201 close to the pushbutton by a pivot pin 2021 and comprises a torsion spring 2022 that normally maintains the control bar 202 in a horizontal condition. When the umbrella is in a compressed and ready-to-use condition, the runner 4 is retained by the projection bar 2012 of the control ring 201 and the control bar 202 is pushed downward by a second central shaft segment 32 of the central shaft unit 3 to become inclined. The bullet-head member 5 is pushed by an inner tube 34 received in a third central shaft segment 33 and biased by a spring plate 311 to engage a retention hole defined in a first central shaft segment 31 of the central shaft unit 3. As shown in FIG. 2, when the pushbutton 203 is depressed for the first time, the control ring 201 is pushed inward to have the projection bar 2012 disengaging from the runner 4 and under the action of the umbrella opening spring 6 received inside the central shaft unit 3, opening operation of the umbrella is automatically carried out and under this condition, the control bar 202 returns to the normal horizontal condition and abuts the bullet-head member 5.

To close the umbrella, the pushbutton 203 is pressed down again, and the control bar 202 pushes and causes the bullet-head member 5 to disengage from the first central shaft segment 31, allowing the runner 4 to be movable. Under the action of the umbrella closing springs 71 provided on the ribs 7, the ribs 7 and the umbrella canopy are collapsed and the runner 4 is moved downward (see FIG. 3). Afterward, the top end of the umbrella is forcibly pushed to compress the central shaft unit 3 toward the handle 1, thereby completing the closing of the umbrella as shown in FIG. 1.

However, a problem of the above mentioned self-opening/closing umbrella occurs in the course of compression and thus closing of the umbrella. Closing the umbrella causes compression of the umbrella opening spring 6 received inside the central shaft unit 3. Since the umbrella opening spring 6 is of quite a strength and spring force, a user must applies a great force with his or her hand to compress the umbrella. If the application of force is in error, the compressed umbrella opening spring 6 will spring the central shaft unit 3 back with a great force. This often hurts the hands or other portions of the body of the user. Thus, the closing operation of the known self-opening/closing umbrella is actually dangerous and improvement in this respect is needed.

FIGS. 4 and 5 shows an improvement of self-opening/closing umbrella disclosed in Chinese Patent Application No. 200710009892.1, which provides a design for improving the drawbacks of the previously discussed known self-opening/closing umbrella. This umbrella comprises a handle 1, which receives therein an operation unit 2, a central shaft unit 3, which receives therein an umbrella opening spring 6, and a runner 4 that is coupled to ribs 7 and comprises a pull rope 51 wrapped therearound and having an end fixed to a crown and an opposite end fixed to a bullet-head member 5. The handle 1 additionally receives therein a safety device 8 composed of a rotatable disk 81 and a holding unit 82. The rotatable disk 81 provided with a spring 83 comprises a pull rope 52 wrapped one end to the disk 81 and the other end fixed to the crown 41. The disk has a bottom toothed surface 811 while the holding unit 82 being positioned thereunder with a top blaking pawl 821. A spring 84 is provided under the holding unit for pushing the same upward. A rod 85 passes through the disk 81 and contact the top surface of the holding unit 82.

The use of said structure is after closing the umbrella, wherein the rod 85 is moved downward by the bullet-head member 5 to press the holding unit 82 that releases the engagement between the pawl 821 and the toothed surface 811 of the disk 81. When to close the umbrella again after opening, it is to push the operation unit 2 to force the bullet-head member 5 upward that separates the contact of the rod 85. The holding unit 82 will be moved upward by the spring 84 in order that the pawl 821 and the toothed surface 811 are engaged. Hence, in use of the safety device 8, when compressing the shaft unit 3, it will be safe to prevent from damage of users since the holding unit 82 and the disk 81 are fixed and the shaft unit 3 will not be elastically extended.

This arrangement also uses the operational cooperation between the rod 85 and the bullet-head member 5 to control the movement of the holding unit 82 and the engagement with the disk 81. Again, this arrangement is still lack of effect that has a large volume of the assembly and is inconvenient for use. Thus, this arrangement is necessary to be improved.

SUMMARY OF THE INVENTION

The primary object of the present invention is to provide a central shaft control structure of self-opening/closing umbrella, of which an application to a three-fold umbrella is taken as example, wherein a control structure for self-opening/closing of umbrella is arranged in a handle of the umbrella and comprises a safety device composed of a reversal prevention wheel having a toothed surface, an operation bar comprising a pawl, and a barrel fit over the operation bar. The reversal prevention wheel comprises a safety rope wrapped therearound and having an end fixed to a third central shaft segment, whereby when errors occur in the course of compression in closing the umbrella, the operation bar is biased by a spring to have the pawl thereof engaging the toothed surface of the reversal prevention wheel so as to prevent the reversal prevention wheel from rotation. With the safety rope of the reversal prevention wheel holding the third central shaft segment, the central shaft that is in a compressed condition is retained in position, so that instantaneous spring back of the central shaft caused by the compressed umbrella opening spring can be prevented. This structural arrangement of the combination of this safety device with the central shaft unit ensures safety of operation and control of the self-opening/closing umbrella and will not increase the volume of the holder.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION ION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
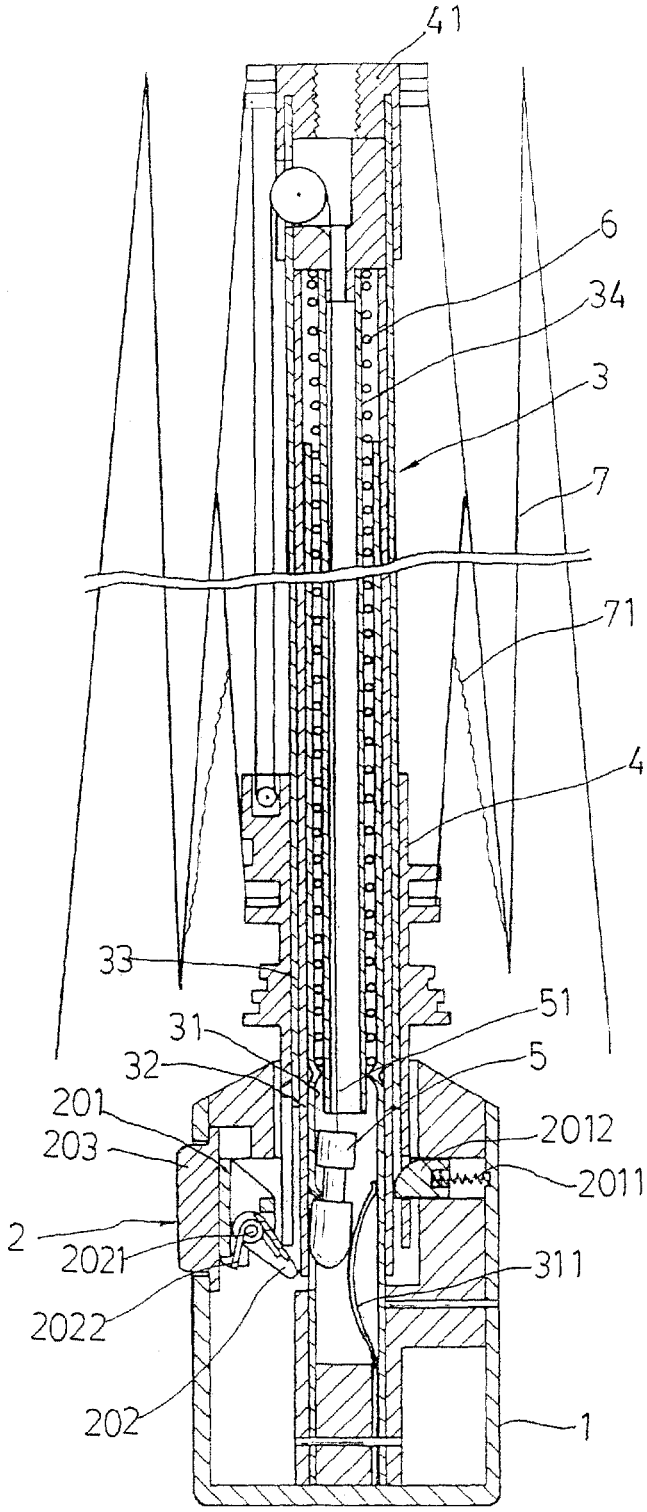
FIG.1 PRIOR ART
FIGS. 1-3 are schematic views illustrating structural arrangement and operation of a conventional self-opening/closing umbrella.
Figure 2:
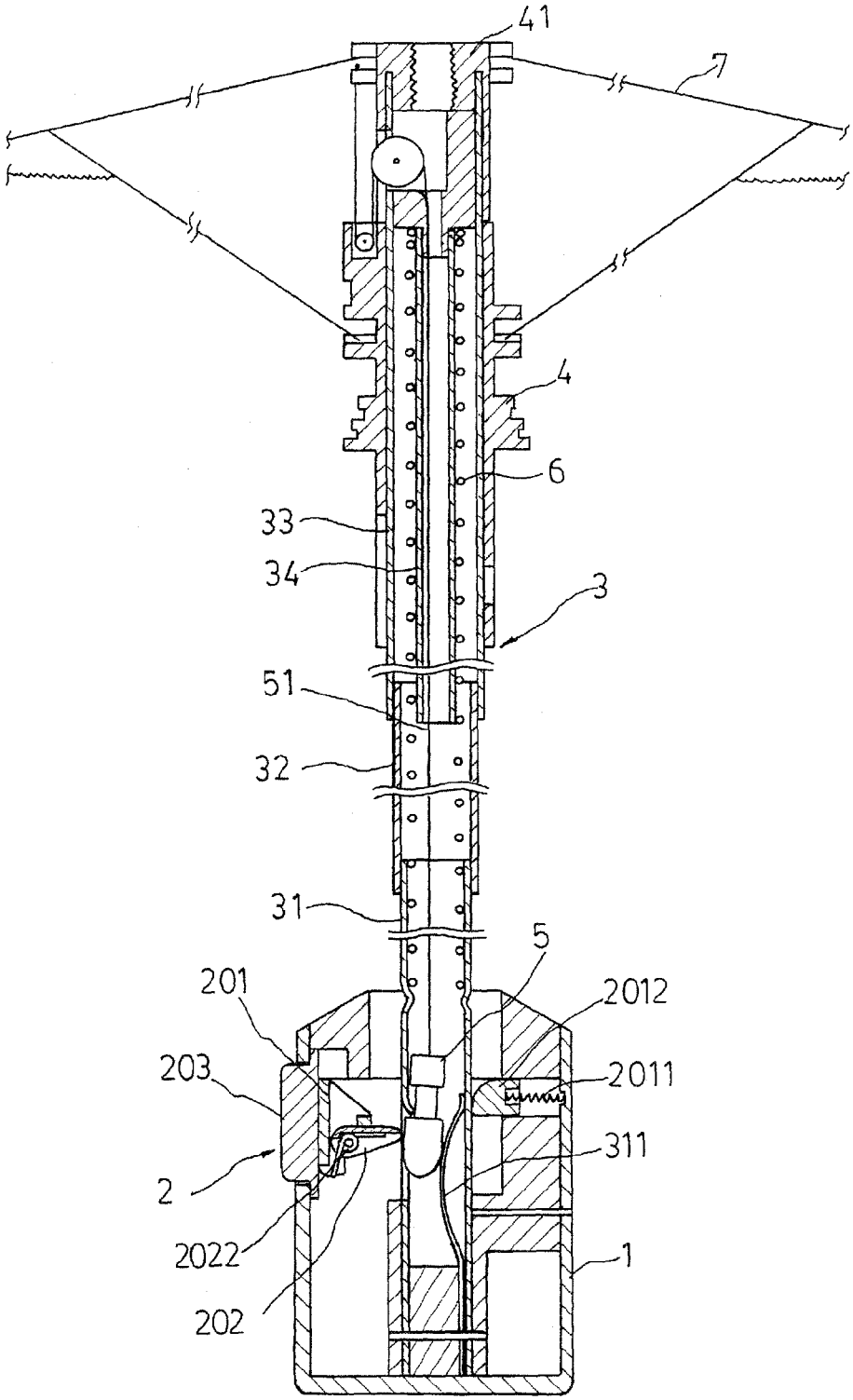
FIG.2 PRIOR ART
Figure 3:
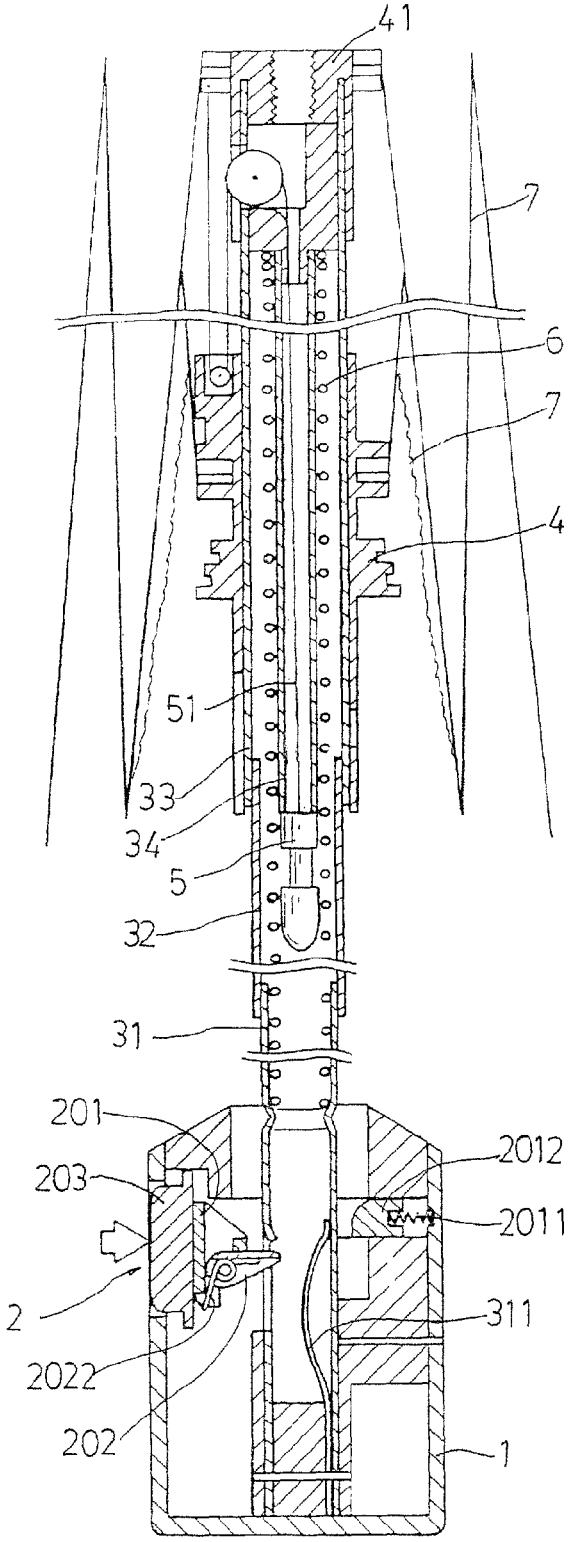
FIG.3 PRIOR ART
Figure 4:
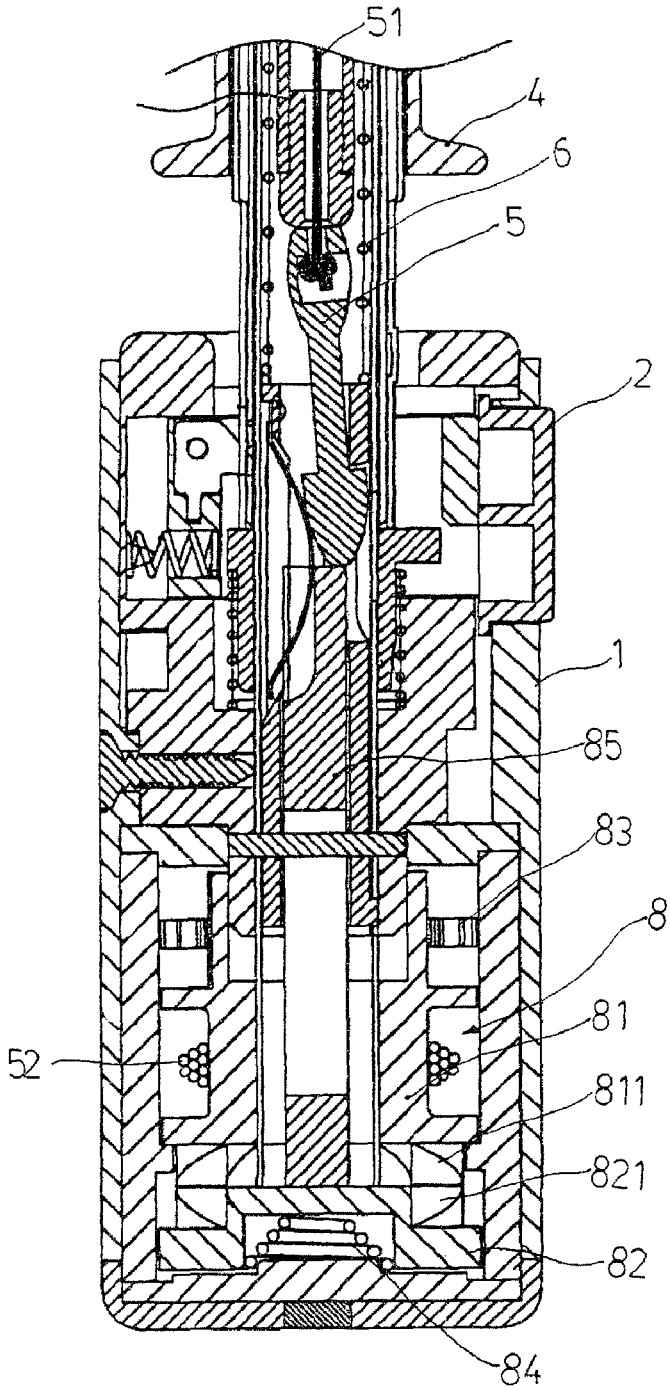
FIG.4 PRIOR ART
FIGS. 4 and 5 are schematic views illustrating structural arrangement of another conventional self-opening/closing umbrella comprising a safety device.
Figure 5:
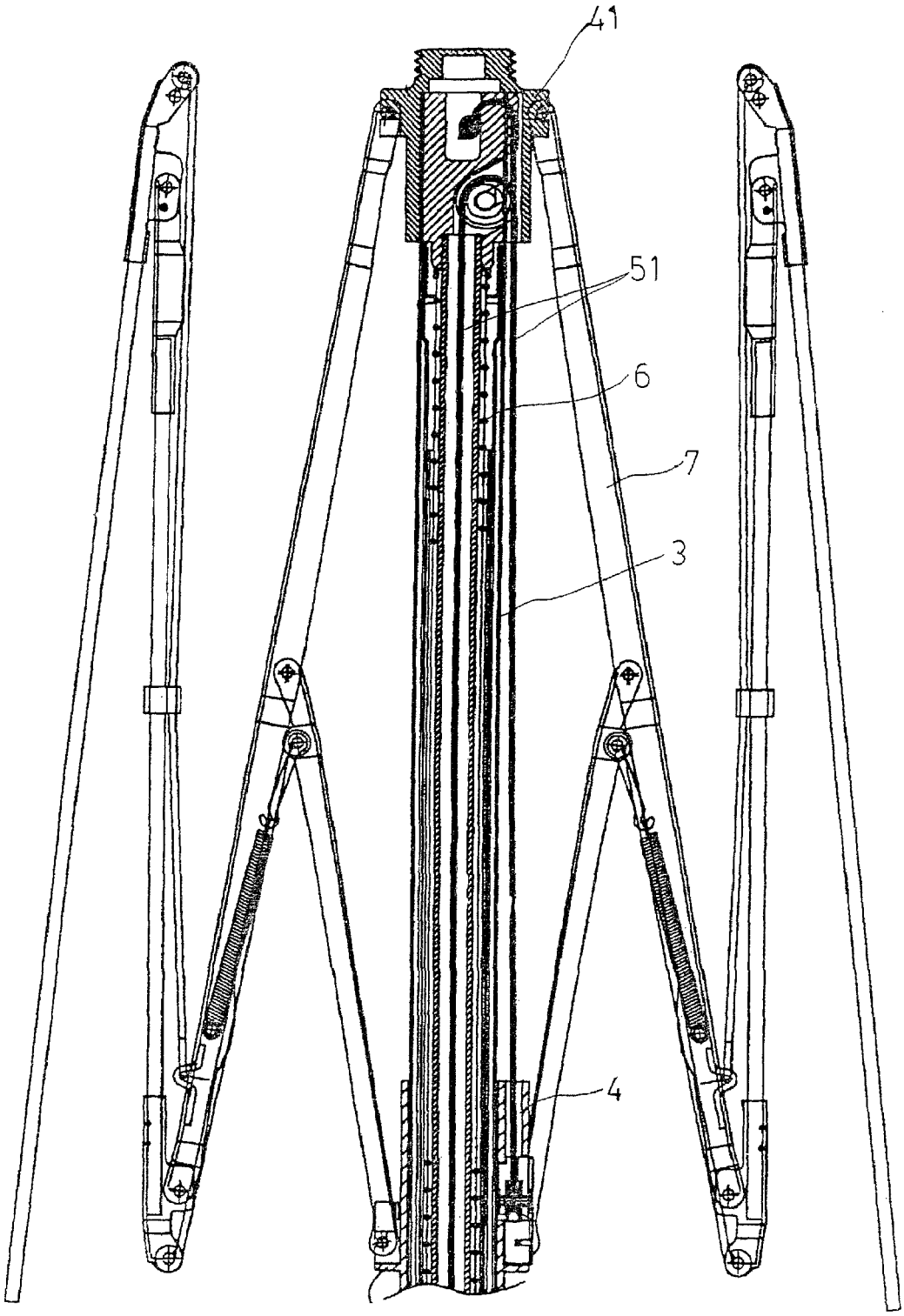
FIG.5 PRIOR ART
Figure 6:
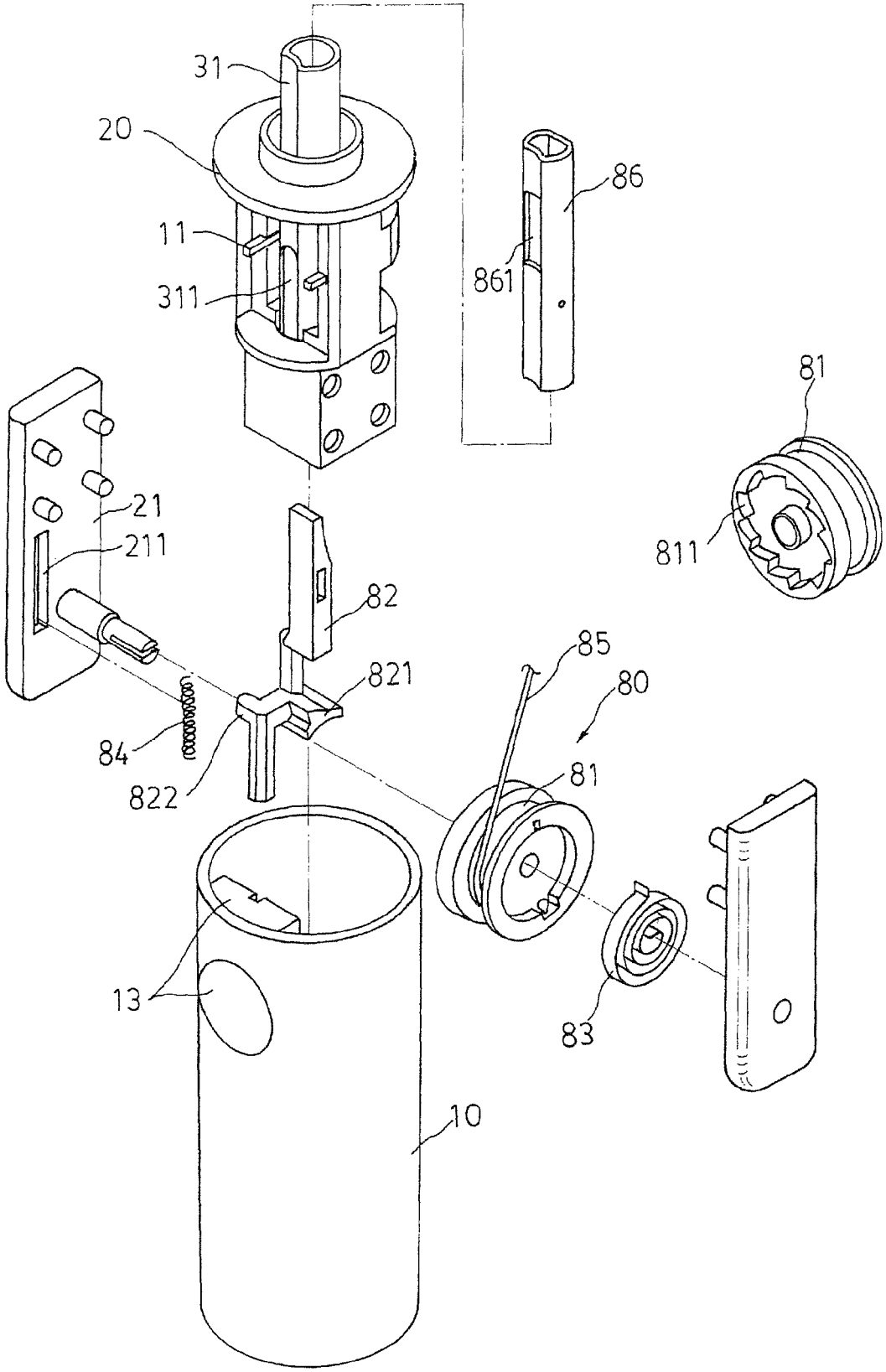
FIG. 6 is an exploded view of a central shaft control structure according to an embodiment of the present invention.

Referring to FIGS. 6-7, the present invention relates to a central shaft control structure of a self-opening/closing umbrella, which will be explained with reference to an example of a three-fold umbrella, generally comprising the following constituent components including a handle 10, a central shaft unit 30, a runner 40, a bullet-head member 50, an umbrella opening spring 60, and ribs 70. The handle 10 is provided with a pushbutton 13. The central shaft unit 30 is composed of a first shaft segment 31, a second shaft segment 32, and a third shaft segment 33. The first shaft segment 31 has a lower end coupled to the handle 10. The runner 40 is fit over the third shaft segment 33. The third shaft segment 33 has an upper end to which a crown 41 is fixed and a lower end having an outer circumference to which a ring 331 forming a retention hole 3311 is fixed. The ribs 70 are coupled between the runner 40 and the crown 41. The crown 41 has a lower end to which an inner tube 34 that is received inside the central shaft unit 30 is fixed. The umbrella opening spring 60 is arranged between the first shaft segment 31 and the inner tube 34. The bullet-head member 50 is set below the inner tube 34 and has an upper end to which a pull rope 51 is attached so that the pull rope 51 extends upward through the inner tube 34 and wraps around a pulley set inside the crown 41 and further projects outwards to wrap around a pulley set inside the runner 40 to have a distal end thereof attached to the crown 41.

The control structure of the present invention is arranged inside the handle 10, comprising a base 20 having a lower end to which a coupling seat 20 forming a pivot bar 212 is mounted for rotatably coupling a safety device 80 composed of a reversal prevention wheel 81, an operation bar 82, and a barrel 86. The base 20 has an upper portion coupled to first shaft segment 31 of the central shaft unit 30 and has a front side that is made hollow to which a hole 311 formed in the first shaft segment 31 corresponds and farther comprises a control collar 11 that has a rear side having an inside surface to which a projecting block 111 is provided and an outside surface biased by a spring 12. The control collar 11 has a front side that is set in engagement with an inside surface of the pushbutton 13 that is received in an opening defined in the handle 10. The inside surface of the pushbutton 13 comprises a pivot pin that rotatably couples a control bar 14 at a location opposite to the projecting block 111. The control bar 14 is provided with a torsion spring to normally maintain the control bar 14 at a horizontal condition. The operation bar 82 of the safety device 80 has a lower end to which a single-side-inclined pawl 821 is mounted and comprises a retention plate 822 formed at one side thereof. A spring 84 is further provided and is received in a receiving channel 211 defined in the coupling seat 21 to form a biasing engagement with the retention plate 822. The reversal prevention wheel 81 forms a pivot hole that is fit over the pivot bar 212 of the coupling seat 21 and has a surface that faces the operation bar 82 and forms a toothed surface 811 forming a plurality of ratchet teeth each having a single side inclined in a direction opposite to the pawl 821 and an opposite surface forming a circular recess for receiving a winding spring 83. The winding spring 83 has an inner end fixed to the pivot bar 212 and an outer end fixed to a circumferential wall of the circular recess. The reversal prevention wheel 81 comprises a safety rope 85 wrapping therearound and having an end fixed to the reversal prevention wheel 81 and an opposite end extending through the base 20 to attach to the ring 331 of the third shaft segment 33. Finally, the pivot bar 212 is fit into a pivot hole defined in a cover board that is coupled to the base 20. The barrel 86 is fixed inside the bottom portion of the first shaft segment 31 to receive the operation bar 82 to insert therein and forms, in a surface thereof opposing the hole 311 of the first shaft segment 31, an opening 861 that has an upper end forming an inward bent stop block 862 and is further provided with a spring plate 863 fixed to an inside surface thereof opposite to the opening 861.

Figures 7A, 7B:
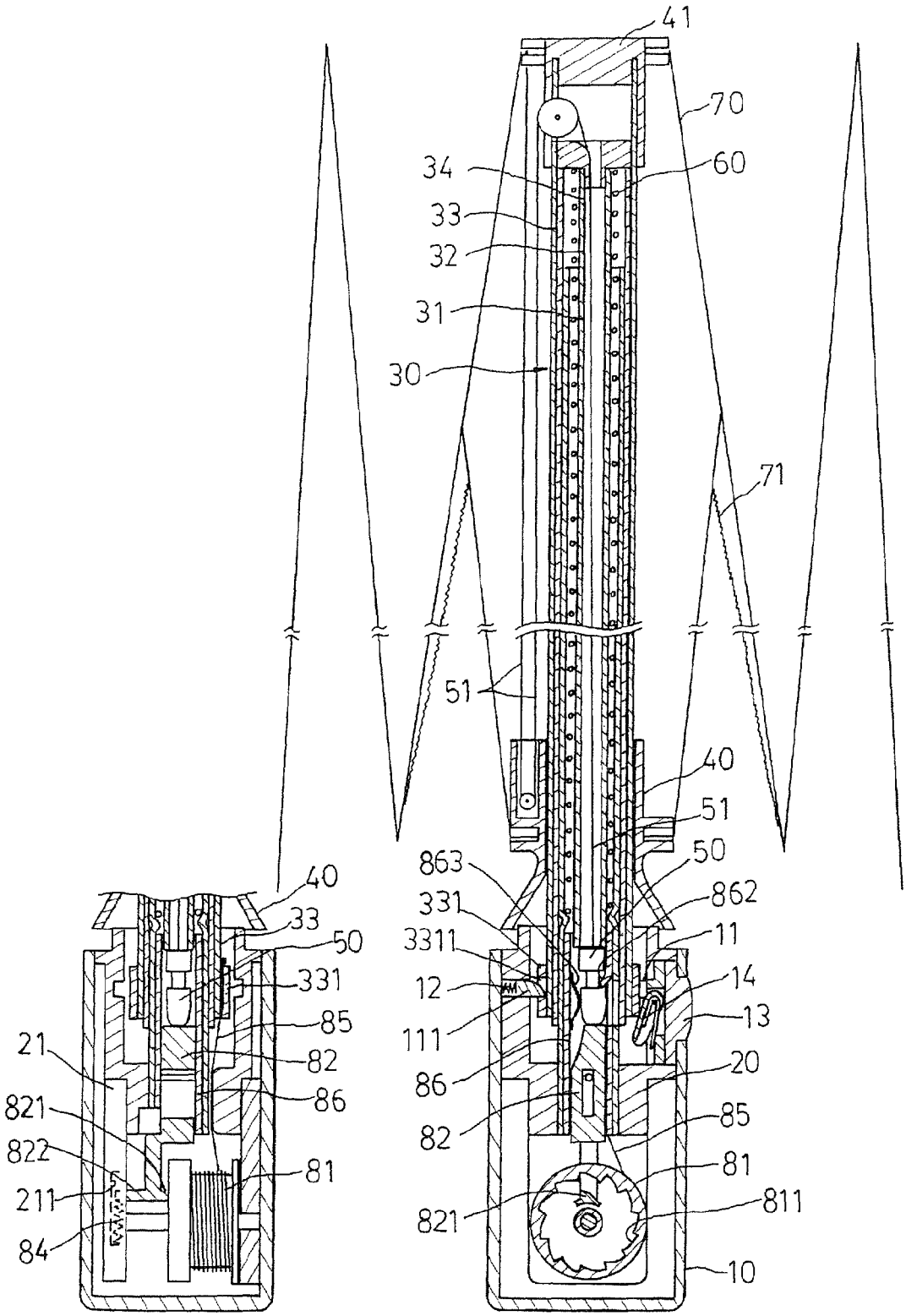
FIGS. 7-9 are schematic views illustrating structural arrangement and operation of the central shaft control structure according to the present invention.

Referring to FIGS. 7A and 7B, which illustrate the spatial relationship of the components of the self-opening/closing umbrella of the present invention in a compressed condition for closing the umbrella, the retention hole 3311 defined in the ring 331 of the third shaft segment 33 engages and is retained by the projecting block 111 of the control collar 11 to hold the central shaft unit 30 in position. At the same time, the control bar 14 is pushed downward by the third shaft segment 33 and becomes inclined. The bullet-head member 50 is coupled to the runner 40 with the pull rope 51 is pushed downward by the inner tube 34 and is biased by the spring plate inside the barrel 86 of the first shaft segment 31 to engage and thus be retained by the stop block 862. Meanwhile, the bullet-head member 50 drives the operation bar 82 downward to have the pawl 821 of the operation bar 82 disengage from the toothed surface 811 of the reversal prevention wheel 81. Under this condition, the winding spring 83 received in the reversal prevention wheel 81 is in a completely released condition and the safety rope 85 is wound around the reversal prevention wheel 81.

Figures 8A, 8B:
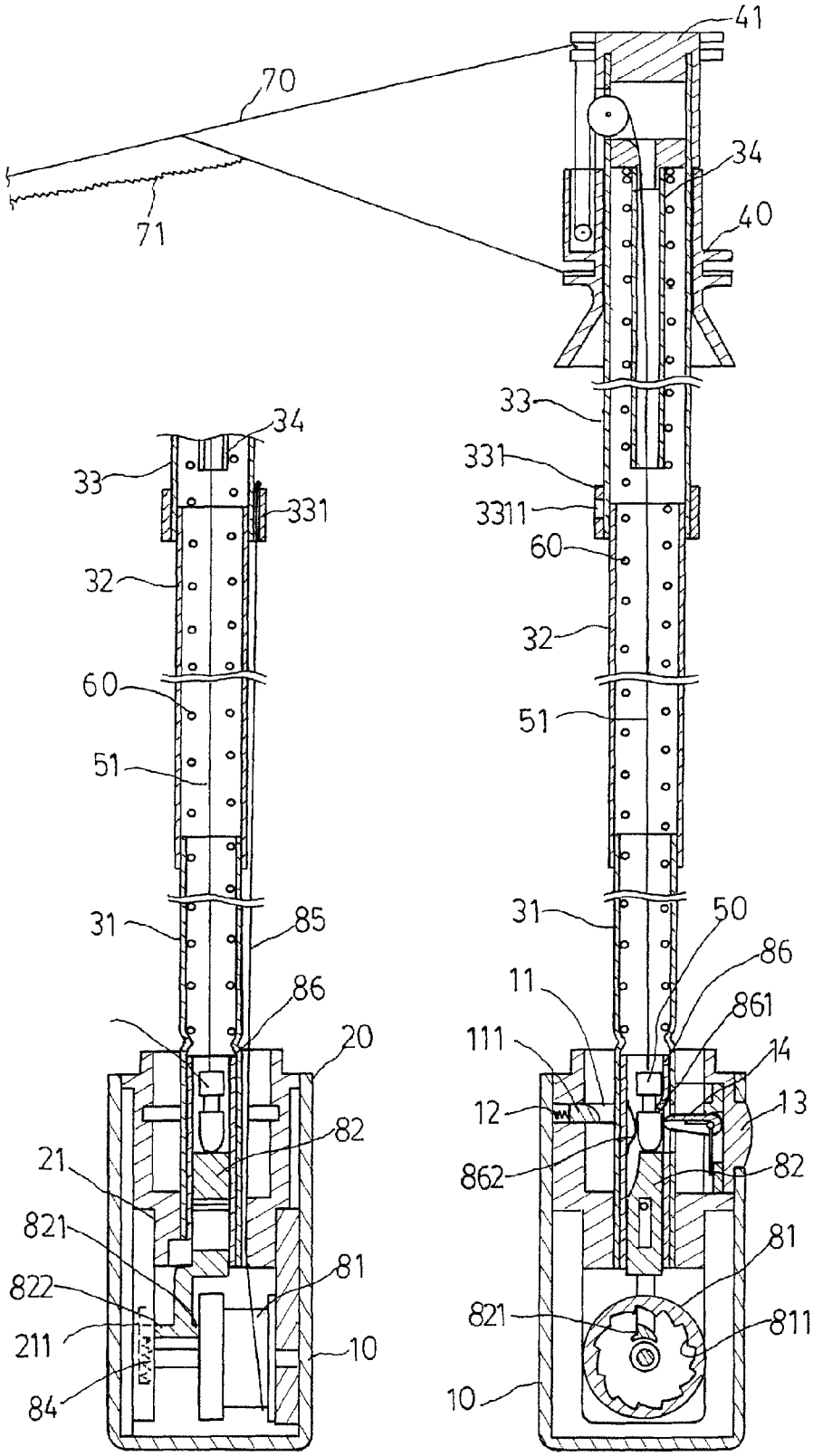

Referring to FIGS. 8A and 8B, to open the umbrella, the pushbutton 13 is depressed to move the control collar 11 inward thereby disengaging the projecting block 111 from the retention hole 3311 defined in the ring 331 of the third shaft segment 33. Under the action of the umbrella opening spring 60 arranged inside the central shaft unit 30, the central shaft unit 30 is fully expanded and the runner 40 that moves upward with the central shaft unit 30 forcibly expands all the ribs 70 to complete the operation of opening umbrella. Under this condition, the control bar 14 returns to the horizontal condition and abuts the bullet-head member 50. The safety rope 85 that has an end fixed to ring 331 of the third shaft segment 33 is extended with the upward movement of the third shaft segment 33 and causes counterclockwise rotation of the reversal prevention wheel 81, making the winding spring 83 to wind up inside the reversal prevention wheel 81.

Figure 9B:
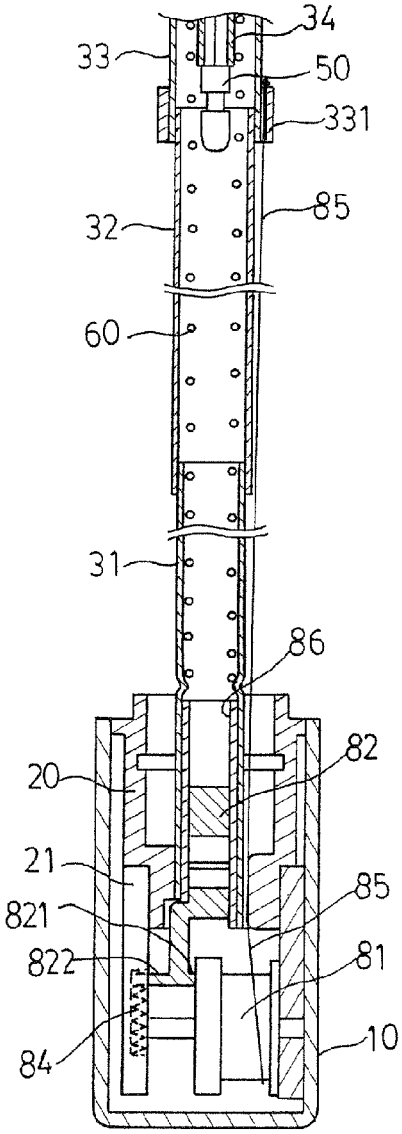
Figure 9A:
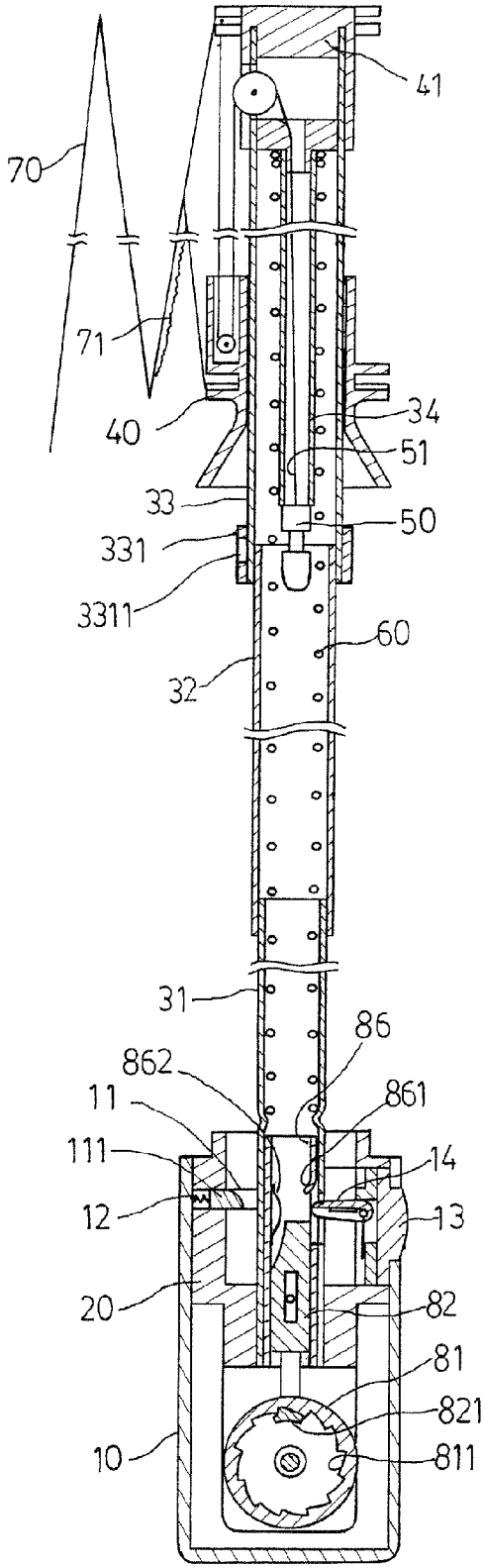

Referring to FIGS. 9A and 9B, to close the umbrella, the pushbutton 13 is depressed again and by doing so, the control bar 14 pushes the bullet-head member 50 in such a way to disengage the bullet-head member 50 from the stop block 862 inside the barrel 86 of the first shaft segment 31. Due to the action of an umbrella closing spring 71 provided in each rib 70, the rib 70 is collapsed and drives the runner 40 downward. The pull rope 51 moves the bullet-head member 50 upward to the lower end of the inner tube 34. Under this condition, the operation bar 82 that is inside the barrel 86 is no longer held in position by the bullet-head member 50 and the retention plate 822, under the action of the spring 84, drives the operation bar 82 upward to move the pawl 821 into engagement with the toothed surface 811 of the reversal prevention wheel 81.

Referring to FIGS. 7-9, the final step of closing umbrella is to compress the central shaft unit 30 of the umbrella. When the central shaft unit 30 is acted upon and thus compressed by an external force, the safety rope 85 follows the inward retraction of the third shaft segment 33 to release. Under this condition, the reversal prevention wheel 81 is acted by the returning spring force of the winding spring 83 to rotate in the clockwise direction. Due the fact that the inclination of the ratchet teeth of the toothed surface 811 of the reversal prevention wheel 81 is opposite to the that of the pawl 821 of the operation bar 82 for engagement to be established therebetween, when the reversal prevention wheel 81 rotates clockwise, the toothed surface 811 is not constrained by the pawl 821 of the operation bar 82, but when the compression force is removed, the spring force induced by the umbrella opening spring 60 inside the central shaft unit 30 tends to extends the central shaft unit 30 and the extension force causes the reversal prevention wheel 81 to rotate counterclockwise due to the safety rope 85 being coupled to the third shaft segment 33; this makes the pawl 821 of the operation bar 82 engaging the single-side-inclined ratchet teeth of the toothed surface 811 of the reversal prevention wheel 81 thereby preventing the reversal prevention wheel 81 from counterclockwise rotation and holding the third shaft segment 33 in position to immediately stop undesired movement and thus abrupt expansion of the central shaft unit 30. Thus, when the umbrella compression operation slips up, the reversal prevention wheel 81 is held in position by the operation bar 82 and the central shaft unit 30 is kept in position to prevent the central shaft unit 30 from being acted upon by the compressed umbrella opening spring 60 to induce instantaneous spring back or undesired expansion of the ribs 70, whereby operation safety of the self-opening/closing umbrella can be ensured.

Figure 10:
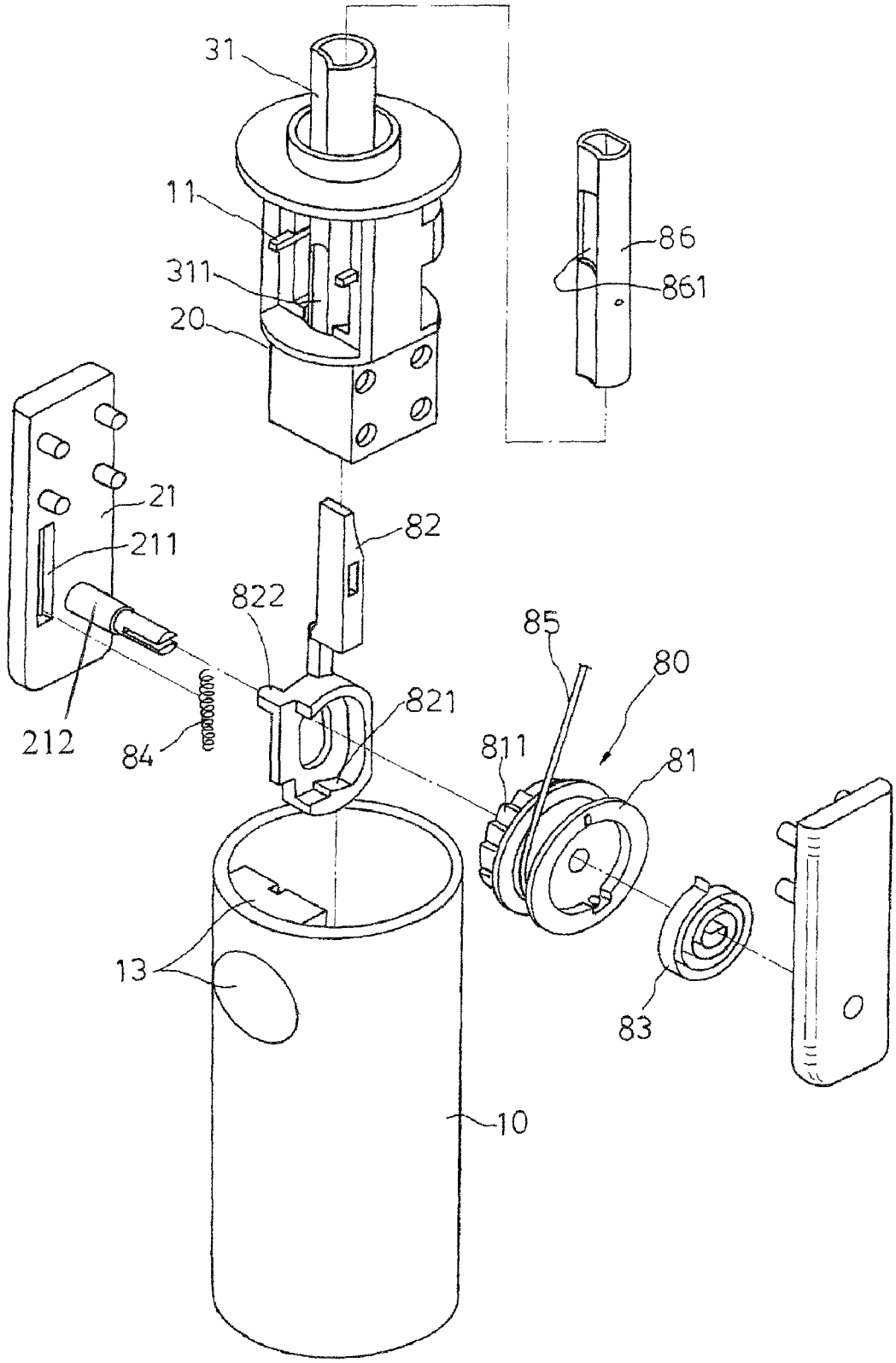
FIG. 10 is an exploded view of a central shaft control structure according to another embodiment of the present invention.

Referring to FIG. 10, a modification of the reversal prevention wheel 81 and the operation bar 82 of the safety device 80 according to the present invention is shown. The reversal prevention wheel 81 has a surface that faces the operation bar 82 and forms a toothed surface 811 forming a plurality of ratchet teeth each having a single side inclined in a direction opposite to an inclined side of the pawl 821. The operation bar 82 forms a frame that has a bottom having an inside surface forming the pawl 821 that is inclined in a single side and has a surface area greater than the toothed surface 811 to encompass outside the toothed surface 811 and comprises a retention plate 822 formed at one side thereof and biased by a spring 84. The operation of the operation bar 82 is similar to what descried above and realizing the same function.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A central shaft control structure of a self-opening closing umbrella including a control assembly with a safety device mounted inside a handle of the umbrella, wherein the safety device comprises:

a base is coupled to a first shaft segment and has a front side that is made hollow to which a hole formed in the first shaft segment corresponds and further comprises a control collar that has a rear side having an inside surface to which a projecting block is provided and an outside surface biased by a spring, the control collar having a front side that is set in engagement with an inside surface of a pushbutton, the lower end of the base being coupled to a coupling seat that forms a pivot bar and a receiving channel;

a barrel is fixed inside a bottom portion of the first shaft segment and forms, in a surface thereof opposing the hole of the first shaft segment, an opening that has an upper end forming an inward bent stop block and is further provided with a spring plate fixed to an inside surface thereof opposite to the opening;

an operation bar has an upper end fit into the barrel and a lower end to which a single-side-inclined pawl is mounted and comprises a retention plate formed at one side thereof, a spring being provided and received in the receiving channel of the coupling seat to form a biasing engagement with the retention plate; and a reversal prevention wheel forms a pivot hole that is fit over the pivot bar of the coupling seat and has a surface that faces the operation bar and forms a toothed surface forming a plurality of ratchet teeth each having a single side inclined in a direction opposite to the inclined side of the pawl and an opposite surface forming a circular recess receiving a winding spring, the winding spring having an inner end fixed to the pivot bar and an outer end fixed to a circumferential wall of the circular recess, the reversal prevention wheel comprising a safety rope wrapping therearound and having an end fixed to the reversal prevention wheel and an opposite end extending through the base to attach to a ring of a third shaft segment.

2. The central shaft control structure of a self-opening closing umbrella according to claim 1, wherein the reversal prevention wheel of the safety device has a surface that faces the operation bar and forms a toothed surface forming a plurality of ratchet teeth each having a signal side inclined in a direction opposite to an inclined side of a pawl and wherein the operation bar forms a frame that has a bottom having an inside surface forming the pawl that is inclined in a single side and has a surface area greater than the toothed surface to encompass outside the toothed surface and comprises a retention plate formed at one side thereof and biased by a spring.

3. The central shaft control structure of a self-opening closing umbrella according to claim 1, wherein the reversal prevention wheel of the safety device comprises a safety rope wrapping therearound and having an end fixed to the reversal prevention wheel and an opposite end extending through the base to attached to the crown.

4. The central shaft control structure of a self-opening closing umbrella according to claim 1, wherein the control structure of the self-opening closing umbrella is mounted to an umbrella of at least three folds.

* * * * *